US009907358B2

(12) United States Patent
Ariola et al.

(10) Patent No.: US 9,907,358 B2
(45) Date of Patent: Mar. 6, 2018

(54) FOOTWEAR WITH TACTILE-FEEDBACK MEMBERS

(71) Applicant: NIKE, Inc., Beaverton, OR (US)

(72) Inventors: Elmar Ariola, Portland, OR (US); Cory B. McCullagh, Portland, OR (US); Tim Sites, Vancouver, WA (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/215,789

(22) Filed: Jul. 21, 2016

(65) Prior Publication Data

US 2018/0020776 A1 Jan. 25, 2018

(51) Int. Cl.

| | |
|---|---|
| ***A43B 5/00*** | (2006.01) |
| ***A43B 23/02*** | (2006.01) |
| ***A43B 5/12*** | (2006.01) |
| ***A43B 13/04*** | (2006.01) |
| ***A43B 13/12*** | (2006.01) |
| ***A43B 13/18*** | (2006.01) |
| ***A43B 5/02*** | (2006.01) |

(52) U.S. Cl.

CPC ..... *A43B 23/0245* (2013.01); *A43B 5/00* (2013.01); *A43B 5/025* (2013.01); *A43B 5/12* (2013.01); *A43B 13/04* (2013.01); *A43B 13/12* (2013.01); *A43B 13/181* (2013.01); *A43B 13/187* (2013.01); *A43B 23/02* (2013.01); *A43B 23/0215* (2013.01)

(58) Field of Classification Search

CPC ..... A43B 5/00; A43B 5/025; A43B 5/007; A43B 23/02; A43B 23/30

USPC ..... 36/114, 132, 133, 45

See application file for complete search history.

(56) References Cited

U.S. PATENT DOCUMENTS

| | | | | |
|---|---|---|---|---|
| 4,050,167 | A | 9/1977 | Senter | |
| 4,393,605 | A | 7/1983 | Spreng | |
| 4,562,652 | A | 1/1986 | Hensler | |
| 4,897,936 | A * | 2/1990 | Fuerst | A43B 13/223 36/114 |
| 5,331,753 | A | 7/1994 | Rodibaugh | |
| 5,513,449 | A | 5/1996 | Gramola | |
| D417,948 | S | 12/1999 | Cooper | |
| D433,217 | S | 11/2000 | Link | |
| 6,315,571 | B1 | 11/2001 | Lee | |
| D460,252 | S | 7/2002 | Smith | |
| 6,523,282 | B1 * | 2/2003 | Johnston | A43B 5/02 36/133 |

(Continued)

*Primary Examiner* — Marie Bays

(74) *Attorney, Agent, or Firm* — Shook, Hardy & Bacon, L.L.P.

(57) ABSTRACT

An upper for an article of footwear comprises one or more tactile-feedback members. The tactile-feedback members include a first ridge and a second ridge formed in one or more textile elements of the upper. The first ridge and the second ridge protrude from an outward-facing surface of the textile elements and away from the inward-facing surface of the textile elements and extend toward a midfoot region of the upper from a rear-foot region. The first ridge and the second ridge further comprise an arch shape, and the first ridge is superior to the second ridge. The upper may further include other tactile-feedback members, including a finger pad on the heel side of the upper, the finger pad comprising a non-textile material, and a forefoot grip extending over at least a portion of the superior surface of the upper in the forefoot region.

18 Claims, 6 Drawing Sheets

(56) References Cited

U.S. PATENT DOCUMENTS

D494,357 S 8/2004 Del Biondi
6,910,288 B2 * 6/2005 Dua ..... A43B 1/04 12/146 C
D560,898 S 2/2008 Hlavacs et al.
7,424,783 B2 * 9/2008 Meschter ..... A41D 1/04 2/227
7,594,345 B2 9/2009 Fusco
7,926,203 B2 4/2011 Wilkenfeld
8,266,827 B2 * 9/2012 Dojan ..... A43B 23/025 36/45
8,356,429 B2 1/2013 Eder et al.
8,418,380 B2 * 4/2013 Dojan ..... A43B 1/0072 36/45
8,505,216 B2 * 8/2013 Sokolowski ..... A43B 23/0235 12/146 C
D696,854 S 1/2014 Miner
8,800,172 B2 8/2014 Dua et al.
2003/0196354 A1 10/2003 Chu
2004/0118018 A1 * 6/2004 Dua ..... A43B 1/04 36/45
2005/0005478 A1 * 1/2005 James ..... A43B 3/0078 36/132
2005/0193592 A1 * 9/2005 Dua ..... A43B 1/04 36/45
2006/0048413 A1 * 3/2006 Sokolowski ..... A43B 23/0235 36/45
2007/0022627 A1 * 2/2007 Sokolowski ..... A43B 1/04 36/3 A
2009/0014424 A1 * 1/2009 Meschter ..... A41D 31/02 219/121.69
2010/0043254 A1 * 2/2010 Dobbin ..... A43B 5/16 36/114
2011/0016750 A1 1/2011 Crowley et al.
2011/0239485 A1 * 10/2011 Hooper ..... A43B 5/02 36/133
2012/0159813 A1 6/2012 Dua et al.
2013/0008053 A1 1/2013 Nishiwaki et al.
2014/0150289 A1 6/2014 Williams
2014/0283410 A1 * 9/2014 Marvin ..... A43B 23/0235 36/45
2016/0000181 A1 1/2016 Chalk, Jr. et al.
2016/0037862 A1 * 2/2016 Beye ..... A43B 23/029 36/89
2016/0095380 A1 * 4/2016 Minami ..... A43B 5/025 36/114

* cited by examiner

FOOTWEAR WITH TACTILE-FEEDBACK MEMBERS

BACKGROUND

Some activities involve participants physically interacting with one another in a way that requires one participant to be in contact with another participant's footwear. One such activity is performing cheerleading stunts in which one or more cheerleaders support another cheerleader in the air by holding on to the other cheerleader's feet. Maintaining balance during a stunt is often critical and may be affected by the supporting cheerleader's grip on the other cheerleader's footwear. At the same time, however, visibility of the footwear may be limited during stunting, requiring the supporting cheerleader to rely on resources other than sight to determine proper hand positioning.

BRIEF DESCRIPTION OF THE DRAWINGS

This technology is described in detail herein with reference to the attached drawing figures, which are incorporated herein by reference, wherein.

DETAILED DESCRIPTION

Subject matter is described throughout this Specification in detail and with specificity in order to meet statutory requirements. But the aspects described throughout this Specification are intended to be illustrative rather than restrictive, and the description itself is not intended necessarily to limit the scope of the claims. Rather, the claimed subject matter might be practiced in other ways to include different elements or combinations of elements that are similar to the ones described in this Specification and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This principle is contemplated by and is within the scope of the claims.

OVERVIEW OF SOME ASPECTS OF THE DISCLOSURE

During various athletic activities, participants physically interact with one another in a particular manner. For instance, cheerleaders perform stunts, sometimes referred to as building pyramids, in which one or more cheerleaders are physically supporting at least one other cheerleader. As used herein, a flyer is the cheerleader being lifted up and/or tossed and is often considered the "top" of a pyramid while a base is the cheerleader holding up or throwing the flyer. Stunting usually requires a base to grasp one or more shoes of the flyer. The base's grip on the flyer's shoe effects the amount of support and balance a flyer has when lifted up. Bases often grasp the flyer's shoe quickly in a crowded space with limited ability to visually determine appropriate hand placement around the shoe. Additionally, some stunts involve the base's arms to be extended above the base's head when supporting the flyer, thereby preventing the base from a full view of the base's grip around the shoe. Due to this limited visibility, the base often needs to rely on the sense of touch. Accordingly, footwear worn by the flyer to provide tactile feedback to a base may help the base determine proper hand placement without needing to look at the footwear.

Figure 1:
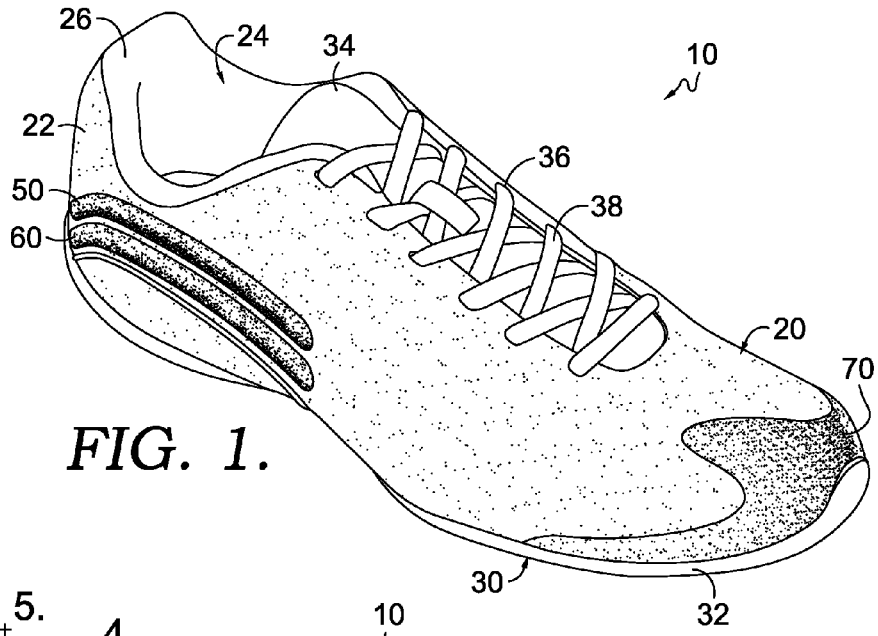
FIG. 1 depicts perspective view of an article of footwear having tactile-feedback members in accordance with an aspect hereof.
Figure 2:
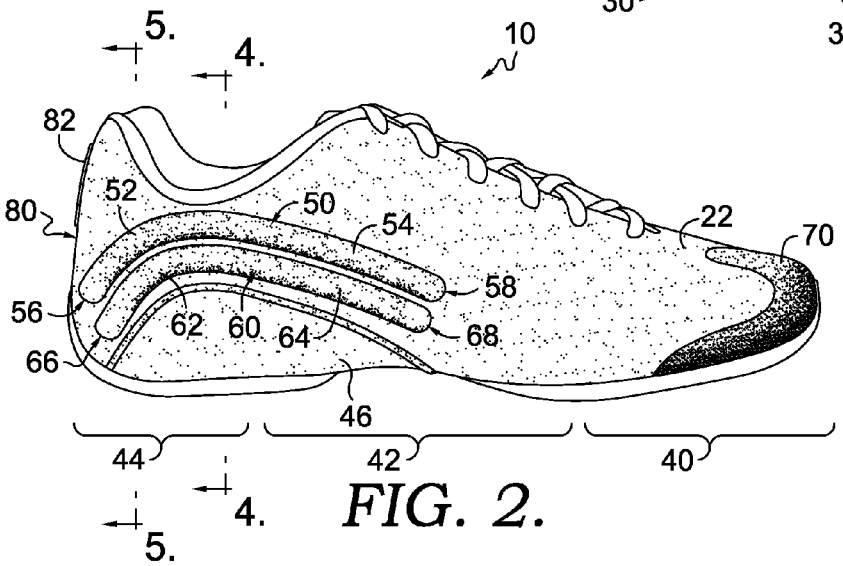
FIG. 2 depicts a lateral side view of the article of footwear of FIG. 1 in accordance with an aspect hereof.
Figure 3:
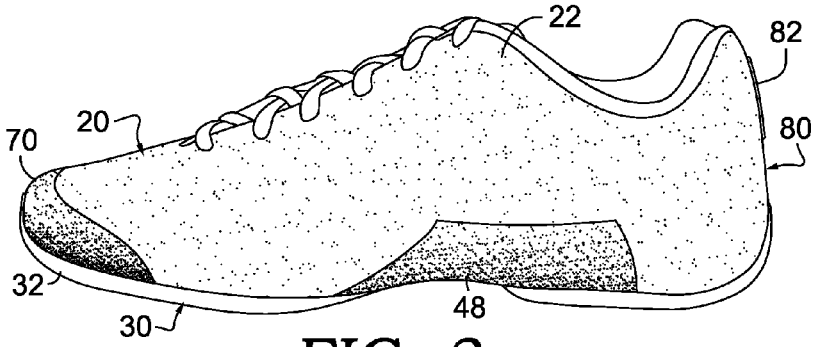
FIG. 3 depicts a medial side view of the article of footwear of FIG. 1 in accordance with an aspect hereof.

The subject matter described in this Specification generally relates to an article of footwear having one or more tactile-feedback elements. Among other features, the article of footwear includes one or more ridges along the lateral side of an upper configured to provide tactile feedback to a secondary user. As used herein, the term "secondary user" refers to person who physically interacts with the footwear when the footwear is being worn by another person. For example, a secondary user may be a base who grips the footwear worn by a flyer during cheerleading stunts. An exemplary article of footwear 10 having tactile-feedback elements is depicted in FIGS. 1-3. The footwear 10 includes an upper 20 comprising a textile element that has various tactile-feedback elements. These tactile-feedback elements may be detected by the secondary's user feeling the exterior of the footwear 10. Example tactile-feedback elements include a first ridge 50 and a second ridge 60 extending along the lateral side of the footwear 10. Various features of the first ridge 50 and the second ridge 60 may contribute to aiding a secondary user to provide adequate support and balance for a wearer of the footwear 10 by providing tactile feedback indicating appropriate hand placement over the footwear 10. The footwear 10 also has additional tactile-feedback elements, including a finger pad 82 formed on the heel side 80 of the upper 20 and a forefoot grip 70 in the forefoot region 40. These and other aspects of the disclosure will be described in more detail in other portions of this Detailed Description.

In the exemplary article of footwear 10 in FIGS. 1-3, the upper 20 may also include one or more overlay portions comprising non-textile material. For example, the footwear 10 may have a lateral side overlay portion 46 and a medial side overlay portion 48. Exemplary non-textile materials comprising the overlay portions includes natural rubber, ethylene vinyl acetate (EVA), thermoplastic polyurethane (TPU), thermoplastic elastomer (e.g., polyether block amide), polyurethane (PU), and the like. The lateral side overlay portion 46 and the medial side overlay portion 48 may be on inferior portions of the upper and extend from the midfoot region 42 to the rear-foot region 44. These overlay portions may comprise one or more of the tactile-feedback elements.

Continuing, the upper 20 and a sole structure 30 generally form a foot-receiving space that encloses at least part of a foot when the article of footwear 10 is worn or donned. The foot-receiving space is accessible by inserting a foot through an opening 24 formed, for example, by the ankle collar 26. When describing various aspects of the article of footwear 10, relative terms may be used to aid in understanding relative relationships. For instance, the article of footwear 10 may be divided into three general regions: a forefoot region 40, a midfoot region 42, and a rear-foot region 44. The article of footwear 10 also includes a lateral side, a medial side, a superior portion, and an inferior portion. The forefoot region 40 generally includes portions of the article of footwear 10 corresponding with the toes and the joints connecting the metatarsals with the phalanges of a donned foot (not shown). The midfoot region 42 generally includes portions of the article of footwear 10 corresponding with the arch area of a donned foot, and the rear-foot region 44 corresponds with rear portions of the donned foot, including the calcaneus bone. The lateral side and the medial side extend through each of regions 40, 42, and 44 and correspond with opposite sides of the article of footwear 10. More particularly, the lateral side corresponds with an outside area of the donned foot (i.e., the surface that faces away from the other foot of a wearer) and the medial side corresponds with an inside area of the donned foot (i.e., the surface that faces toward the other foot of the wearer). Further, the superior portion and the inferior portion also extend through each of the regions 40, 42, and 44. The superior portion generally corresponds with a top portion that is oriented towards a wearer's head when the wearer's feet are positioned flat on the ground and the wearer is standing upright, whereas the inferior portion generally corresponds with a bottom portion oriented towards the bottom of the wearer's foot.

These regions 40, 42, and 44, sides, and portions are not intended to demarcate precise areas of the article of footwear 10. On the other hand, they are intended to represent general areas of the article of footwear 10 to aid in understanding the various descriptions provided in this Specification. In addition, the regions, sides, and portions are provided for explanatory and illustrative purposes and are not meant to require a human being for interpretive purposes.

Additionally, the sole structure 30 may include multiple components. As visible in FIG. 1, the sole structure 30 includes the outsole 32 made of a relatively hard and durable material, such as rubber, that is in direct contact with the ground, floor, or other surface. The sole structure 30 may also include a midsole portion formed from a material that provides cushioning and absorbs/attenuates impact force during normal wear and/or athletic training or performance. Examples of materials often used in midsoles are, for example, ethylene vinyl acetate (EVA), thermoplastic polyurethane (TPU), thermoplastic elastomer (e.g., polyether block amide), and the like. The sole structure 30 may further have additional components, including additional cushioning components (e.g., springs, air bags, and the like), functional components (e.g., motion control elements to address pronation or supination), protective elements (e.g., resilient plates to prevent damage to the foot from hazards on the floor or ground), and the like. In addition, the sole structure 30 may include one or more insoles, sockliners, or other layers that are positioned between the foot-receiving space and the outsole 32. The sole structure 30 may also include various other elements such as a heel counter and a toe cap. The article of footwear 10 may also include a tongue 34 and eyelets 36 for lacing a lace 38. One of ordinary skill in the art will recognize that footwear 10 is only an exemplary article of footwear and many other configurations are possible without departing from aspects of this disclosure.

Although FIGS. 1-3 depict one arrangement of the tactile-feedback elements such as the first ridge 50 and the second ridge 60, in other aspects of the technology, the tactile-feedback elements may have different sizes, groupings, positions, orientations, and the like. Additionally, the illustrative figures depict, and the Specification describes, certain styles of articles of footwear, such as articles of footwear worn when engaging in athletic activities (e.g., cheerleading shoes, cross-training shoes, running shoes, and the like). But the subject matter described herein may be used in combination with other styles of articles of footwear.

These various components of the footwear 10 are delineated for explanatory purposes and are not necessarily entirely discrete components or layers. For example, the outsole 32 may include one or more portions that also form part of the midsole, the upper 20, or the midsole and the upper 20, and the midsole may include portions that form part of the outsole 32, the upper 20, or the outsole 32 and the upper 20. One or both of the midsole portion and the outsole 32 may be coupled to the upper 20, throughout or at different portions of the sole structure 30. In addition, tactile-feedback members, such as the first ridge 50 and the second ridge 60, may be considered part of the upper 20, the sole structure 30, or a combination thereof.

Exemplary Lateral-Side Tactile-Feedback Members

As previously mentioned and depicted in FIGS. 1-3, the article of footwear 10 includes tactile-feedback members, including tactile-feedback members disposed on the lateral side of the upper. The tactile-feedback members include a first ridge 50 and a second ridge 60. The first ridge 50 and the second ridge 60 may each extend toward the midfoot region 42 from the rear-foot region 44. In the example illustrated, the first ridge 50 and the second ridge 60 are superior to the lateral side overlay portion 46.

The first ridge 50 may include a first-ridge first end 56 comprising the end of the first ridge 50 in the rear-foot region 44 and a first-ridge second end 58 comprising the end of the first ridge 50 in the midfoot region 42. Similarly, the second ridge 60 may include a second-ridge first end 66 comprising the end of the second ridge 60 in the rear-foot region 44 and a second-ridge second end 68 comprising an end of the second ridge 60 in the midfoot region 42.

As can be seen, the first ridge 50 may be superiorly positioned relative to the second ridge 60, but the first ridge 50 and the second ridge 60 may be substantially similar in shape. The first ridge 50 and the second ridge 60 may each comprise an arched shape or curved shape. Specifically, the first ridge 50 may run from the first-ridge first end 56 in a superior direction and then gradually curve to run in an inferior director towards the first-ridge second end 58, and the second ridge 60 may run from the second-ridge first end 66 in a superior direction and then gradually curve to run in an inferior direction towards the second-ridge second end 68. In some aspects, the curved shapes of the first ridge 50 and the second ridge 60 are asymmetrical in that the most superior point of each curve is in more the posterior portions of the respective ridge, which is shown in FIG. 2. For instance, the first ridge 50 may have a first-ridge first portion 52 and a first-ridge second portion 54, the first-ridge second portion 54 being closer to the midfoot region 42 than the first-ridge first portion 52 and the first-ridge first portion 52 being posterior to the first-ridge second portion 54. Similarly, the second ridge 60 may have a second-ridge first portion 62 and a second-ridge second portion 64, the second-ridge second portion 64 being closer to the midfoot region 42 than the second-ridge first portion 62 and the second-ridge first portion 62 being posterior to the second-ridge second portion 64. The curvature of the first ridge 50 and the second ridge 60 may be such that first-ridge first portion 52 is more superior than the first-ridge second portion 54 and the second-ridge first portion 62 is more superior than the second-ridge second portion 64.

This curvature of the first ridge 50 and the second ridge 60 may also be described as a complex curve in which the arc radius of the curve changes as the curvature of the ridge extends from one end of the ridge to an opposing end of the ridge. Furthermore, in one aspect, as the body of the ridge transitions from the peak towards the ends, the curvature may gradually flatten out, such that the ridge may transition into portions that are substantially straight and elongated. However, in other aspects of the disclosure, a curvature of a ridge may include a simple curve, in which the arc radius of the curvature is substantially constant from one end of the ridge to the opposing end Turning to FIG. 4, the first ridge 50 and the second ridge 60 may each protrude from an outward-facing surface 92 of the textile element 22 and away from an inward-facing surface 94 textile element 22. In other words, the first ridge 50 and the second ridge 60 may be discerned as elevated portions of the textile element 22 when felt from the exterior of the footwear 10. The protruding surfaces of the first ridge 50 and the second ridge 60 may be rounded and may comprise a curve that is convex with respect to the outward-facing surface 92 of the textile element 22. It is contemplated that alternative aspects include a first ridge 50 and a second ridge 60 having non-rounded surfaces. For example, instead of a convex curve, the ridges may appear in a triangular shape or a squared shape when protruding from the outward-facing surface 92.

The degree that the first ridge 50 and the second ridge 60 protrude from the textile element 22 may be measured as a first-ridge setoff 102 and a second-ridge setoff 104, respectively. The first-ridge setoff 102 may be a distance between the outward-facing surface 92 of the textile element 22 and the outermost surface 96 of the first ridge 50, and the second-ridge setoff 104 may be the distance between the outward-facing surface 92 of the textile element 22 and the outermost surface 98 of the second ridge 60. Greater distances for the first-ridge setoff 102 and the second-ridge setoff 104 make the first ridge 50 and the second ridge 60, respectively more noticeable through touch and may provide more surface area that a secondary user's may grip. However, setoffs that are too large may prevent the secondary user from maintaining a close, tight grip on the footwear 10 and may make the footwear 10 unnecessarily bulky.

In some aspects, first-ridge setoff 102 and the second-ridge setoff 104 are the same, but in other aspects, the degrees of protrusion for the first ridge 50 and the second ridge 60 are different. Specifically, the first-ridge setoff 102 may be greater than the second-ridge setoff 104. For example, the first-ridge setoff 102 may be in a range of about 5.0 millimeters to 3.0 millimeters, and the second-ridge setoff 104 may be in a range of about 4.0 millimeters and 2.0 millimeters.

Figure 4:
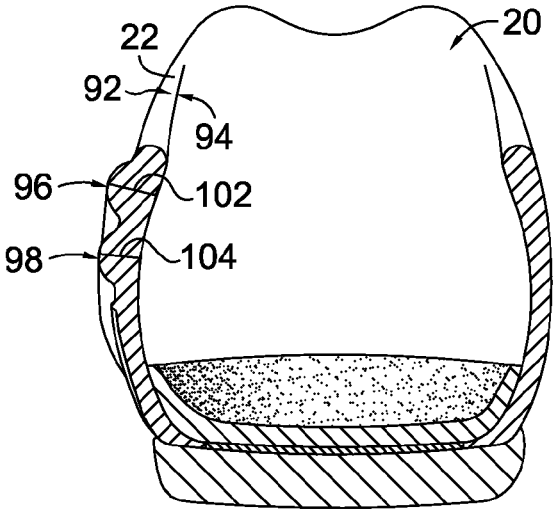
FIG. 4 depicts a cross-sectional view of the article of footwear of FIG. 1, taken at reference line 4 in FIG. 2 in accordance with an aspect hereof.
Figure 5:
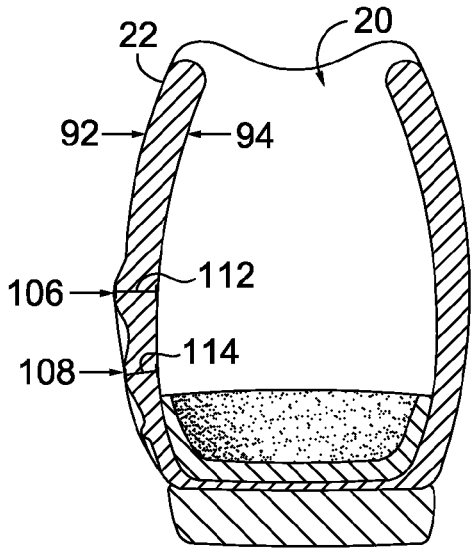
FIG. 5 depicts a cross-sectional view of the article of footwear of FIG. 1, taken at reference line 5 in FIG. 2 in accordance with an aspect hereof.

Additionally, the setoff amount for each of the first ridge 50 and the second ridge 60 may vary at different portions of the first ridge 50 and the second ridge 60. Specifically, the setoff distance may taper off near one or both ends of the first and second ridges 50 and 60, respectively. For example, because FIG. 4 provides a cross-sectional view at medial portions of the first ridge 50 and second ridge 60, the first-ridge setoff 102 may represent the setoff of the first ridge 50 at a medial portion of the first ridge 50, and the second-ridge setoff 104 may represent the setoff of the second ridge 60 at a medial portion of the second ridge 60. But, as illustrated in FIG. 5, more posterior portions of the first ridge 50 and the second ridge 60 may have different setoff amounts. FIG. 5 shows a first-ridge first-end setoff 112 representing a distance between the outward-facing surface 92 of the textile element 22 and an outermost surface 106 of the first ridge 50 at or near the first-ridge first end 56. A second-ridge first-end setoff 114 may represent a distance between the outward-facing surface 92 of the textile element 22 and an outermost surface 108 of the second ridge 60 at or near the second-ridge first end 66. The first-ridge first-end setoff 112 may be less than the first-ridge setoff 102 at a medial portion of the first ridge 50, and the second-ridge first-end setoff 114 may be less than the second-ridge setoff 104 at a medial portion of the second ridge 60. In this way, the setoff distances for the first ridge 50 and the second ridge 60 may decrease gradually as each runs towards the rear-foot region 44 of the footwear 10 or posterior portions of the first ridge 50 and second ridge 60.

Though not shown, the setoffs for the first ridge 50 and the second ridge 60 may gradually taper off at the other end in a similar manner. For example, the first ridge 50 may have a first-ridge second-end setoff at or near the first-ridge second end 58 that is less than the first-ridge setoff 102, and the second ridge 60 may have a second-ridge second-end setoff at or near the second-ridge second end 68 that is less than the second-ridge setoff 104. Thus, degree of protrusion for the first ridge 50 and the second ridge 60 may decrease in the anterior portions of the first and second ridges 50 and 60, respectively.

Because the first ridge 50 and the second ridge 60 protrude from an outward-facing surface 92 of the textile element 22 of the upper 20, the first ridge 50 and the second 60 may be detected by a secondary user feeling the exterior of the footwear 10. For example, the placement of the first ridge 50 and the second ridge 60 may aid a base in determining proper hand positioning during stunts without needing to make visual contact with the footwear 10, as is described in greater detail with respect to FIGS. 8A-10. Further, because the first ridge 50 and the second ridge 60 extend outward from the outward-facing surface 92 of the footwear 10, the first ridge 50 and the second ridge 60 may provide a texture to help the base maintain an adequate grip of the footwear 10.

The upper 20 of the footwear 10 may be constructed out of a layer of engineered mesh with various areas of the upper 20 with non-textile overlays. These non-textile overlays may comprise one or more layers of film, such as thermoplastic urethane film. The first ridge 50 and the second ridge 60 may each comprise one or more layers of thermoplastic polyurethane over a base layer. The one or more layers of thermoplastic polyurethane may comprise an outward-facing surface of each of the first ridge 50 and the second ridge 60.

The first ridge 50 and the second ridge 60 may be molded into the textile element 22. In some embodiments, the first ridge 50 and the second 60 ridge are molded into the textile element 22 using high frequency welding techniques. In some aspects, the outward-facing surface of the first ridge 50 and the second ridge 60 comprises the same material making up the textile element 22. In other aspects, the first ridge 50 and the second ridge 60 comprise a non-textile material, such as TPU.

In alternative embodiments not shown, the article of footwear 10 has additional ridges. For instance, there may be a third ridge inferior to the second ridge 60 on the lateral side or there may be one or more ridges on the medial side of the footwear 10. These additional ridges may include one or more setoffs similar to those of the first ridge 50 and the second ridge 60, and may be used to guide a secondary user's hand positioning on the medial side of the footwear 10.

Exemplary Heel-Side Tactile-Feedback Member

Figure 6A:
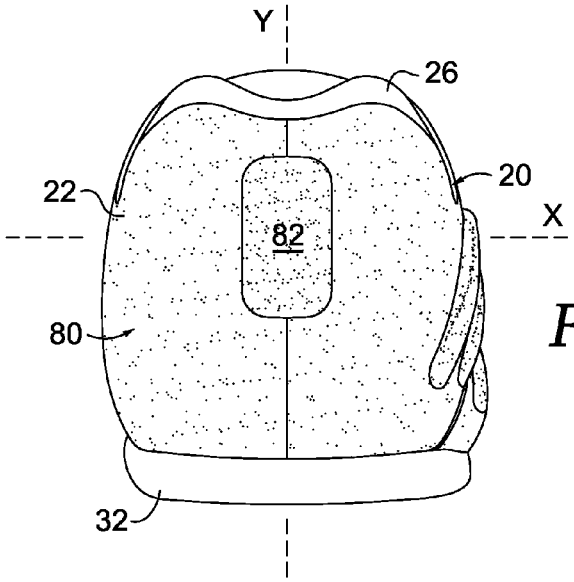
FIG. 6A depicts a back view of the article of footwear of FIG. 1 in accordance with an aspect hereof.

Turning to FIG. 6A, the article of footwear 10 may include a tactile element on the heel side 80 of the upper 20. This element may be a finger pad 82 on which a secondary user may place one of his or her fingers. The shape or profile of the finger pad 82 may correspond to a shape of a distal portion of an index finger, which is a generally oval shape. The center of the finger pad 82 along a horizontal axis X may be aligned with a center of the heel side 80 of the footwear 10. In some embodiments, the center of the finger pad 82 along a vertical axis Y is superior to the center of the footwear 10 along the vertical axis Y. As such, the finger pad 82 may be positioned closer to the ankle collar 26 of the footwear 10 than the sole structure 30. As described with respect to FIGS. 8A-8B, the placement of the finger pad 82 may be an intuitive place for an index finger for certain cheerleading stunts and may provide a place for the index finger to be anchored during stunting to maintain proper grip around the footwear 10.

The finger pad 82 may comprise a non-textile material so that it is texturally distinct from the textile element 22 making up the other portion of the heel side 80 of the upper 20. The non-textile material may comprise polymer or natural rubber materials that provide a different resistance coefficient than the textile element 22 of the upper, such as thermoplastic polyurethane (TPU), ethylene vinyl acetate (EVA), nylon, PEBAX, polyurethane (PU), rubber, or any combinations thereof, that are suitable to be used in accordance with aspects of this disclosure. The non-textile material forming the finger pad 82 may be an extension of the material used to form the outsole 32.

Figure 6B:
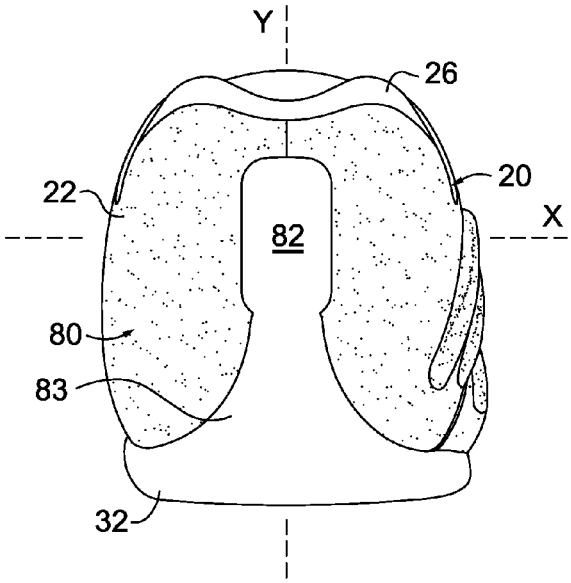
FIG. 6B depicts a back view of an article of footwear having tactile-feedback members in accordance with an alternative aspect hereof.

In some aspects, a portion of the outsole 32 extends from the inferior portion of the footwear 10 up towards a central portion of the heel side 80 to the finger pad 82. The portion of the outsole 32 that extends from the inferior portion of the footwear 10 to the finger pad 82 may be interior to the textile element 22 such that the extending portion is not visible from the exterior while the finger pad 82 itself extends through an opening in the textile element 22. In other aspects, such as the one depicted in FIG. 6B, the extension 83 of the outsole 32 is not covered by textile element 22 and is visible from the exterior of the footwear 10. The extension 83 of the outsole 32 in FIG. 6B is continuous with the finger pad 82 and provides a larger area to act as a guide for placement of the index finger.

In some embodiments, the finger pad 82 provides a generally flat surface on which a secondary user may place his or her finger. In other embodiments, the outward-facing surface of the finger pad 82 is concave to provide an indented portion on which a secondary user places the pad of his her finger. A concave surface of the finger pad 82 may provide a better grip to help keep the finger in proper positioning. Similarly, in aspects that include the extension 83 of the outsole 32 extending into the finger pad 82, the extension 83 may also comprise a concave surface.

Exemplary Forefoot Tactile-Feedback Member

Figure 7:
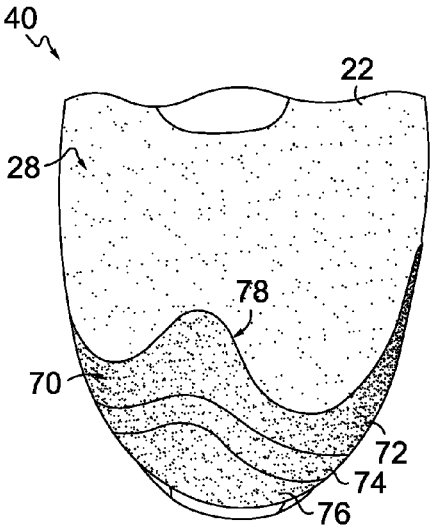
FIG. 7 depicts a top view of a forefoot region of the article of footwear of FIG. 1 in accordance with aspects hereof.

Aspects of the footwear 10 may further include one or more tactile feedback members in the forefoot region 40 of the footwear 10. FIG. 7 provides a top view of the forefoot region 40 of the footwear 10, which includes a forefoot grip 70. The forefoot grip 70 may extend over at least a portion of a superior surface 28 of the textile element 22 in the forefoot region 40. Similar to the finger pad 82, the forefoot grip 70 may comprise a non-textile material so that it is texturally distinct from other portions of the forefoot region 40 the upper 20. The non-textile material may comprise polymer or natural rubber materials that provide a different resistance coefficient than the textile element 22 of the upper 20, such as thermoplastic polyurethane (TPU), ethylene vinyl acetate (EVA), nylon, PEBAX, polyurethane (PU), rubber, or any combinations thereof, that are suitable to be used in accordance with aspects hereof. For instance, in example aspects, the non-textile material comprises TPU.

The forefoot grip 70 may be formed from partially overlapping layers of the non-textile material. For example, the forefoot grip 70 may comprise a base layer 72, an intermediate layer 74, and a top layer 76. A portion of the base layer 72 may be left uncovered by the intermediate layer 74 and the top layer 76, and a portion of the intermediate layer 74 may be left uncovered by the top layer 76. At least the top layer 76 may form a portion of the forefoot grip 70 at a transition between the superior surface 28 and an anterior surface of the article of footwear 10. The portions of the base layer 72 and the intermediate layer 74 left uncovered may form more posterior portions of the forefoot grip 70. This stepped layering of the non-textile material for the forefoot grip 70 may provide additional tactile sensations to a secondary user.

In some aspects, the profile of the forefoot grip 70 may include a protruding edge 78 adjacent to the superior surface 28 of the textile element 22 of the upper 20. The protruding edge 78 may comprise a portion forming a curve that protrudes further into the textile element 22. This portion may be lateral to the center of the forefoot region 40, giving the forefoot grip 70 an asymmetrical shape. This protruding portion of the forefoot grip 70 may generally correspond to the positioning of one or fingers of a secondary user, such as a base cheerleader. For instance, the protruding portion may indicate where the base should place his or her index finger and/or middle finger when gripping the forefoot region 40 of the footwear 10.

Exemplary Use of Tactile-Feedback Elements

Figure 8A:
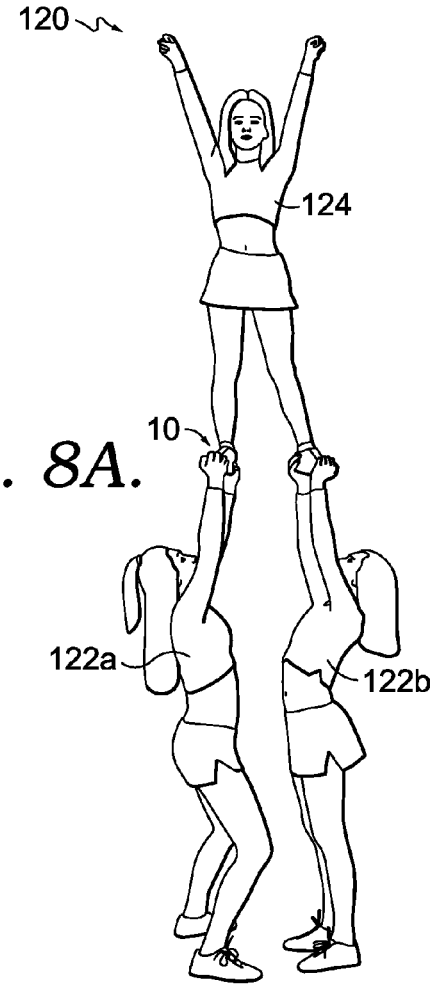
FIGS. 8A-B depict an exemplary use of the article of footwear of FIG. 1 in accordance with aspects hereof.

To better understand the structural features of the tactile-feedback elements, FIGS. 8A-10 illustrate exemplary uses of the footwear 10 with the tactile-feedback elements in the context of cheerleading stunts. In FIG. 8A, a double base extension 120 is shown in which two bases 122*a* and 122*b* lift up a flyer 124 by each holding on to one foot of the flyer 124. FIG. 8B provides a close-up view of base 122*a* holding onto the footwear 10 of the flyer 122. The base 122*a* cradles the footwear 10 of the flyer 124 by placing one hand underneath the rear-foot region 44 and another hand underneath the forefoot region 40 of the footwear 10. The base 122*b* may be holding the footwear 10 on the other foot of the flyer 124 in a similar way.

To help the flyer 124 resist a tendency to roll out his or her ankles during the stunt, each base 122*a-b* may provide support to the lateral side of the footwear 10. The first and second ridges 50 and 60, respectively, may indicate to the base 122*a* to place the thumb of the hand holding up the rear-foot region 44 on the lateral side. As previously mentioned, setoffs of the first ridge 50 and the second ridge 60 may gradually decrease towards the first-ridge first end 56 and the second-ridge first end 66 and, in some embodiments, the first-ridge second end 58 and the second-ridge second end 68. The first and second ridges 50 and 60, respectively, may be formed in the upper 20 so that the portions of the first and second ridges 50 and 60 having the greatest setoffs generally correspond to a central portion of the ankle of wearer, which is the flyer 124 here. Placement of the base's 122*a* thumb at this region may help to support the lateral side of the flyer's 124 ankle, and the difference in the setoff amounts may be physically perceived by the base 122*a* so that the base 122*a* can feel the appropriate position for his or her hand.

Figure 8B:
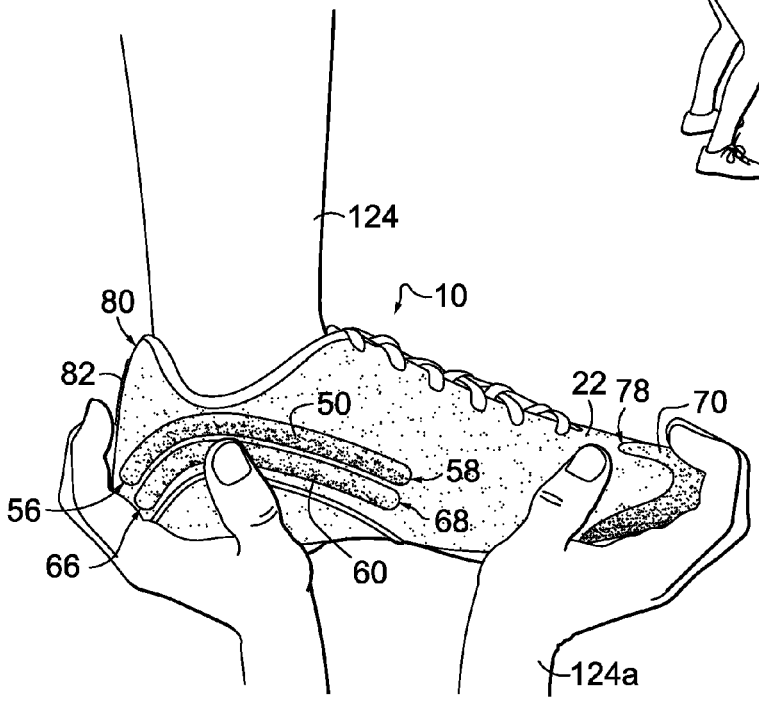

In the example use of the footwear 10 illustrated in FIGS. 8A-8B, the thumb of the base 122*a* is extended only over the second ridge 60. The size of the base's 122*a* hands may determine whether the base 122*a* uses both the first ridge 50 and the second ridge 60 or only the second ridge 60 during this stunt. Even where the base 122*a* uses only the second ridge 60, as shown in FIG. 8B, the setoff 104 of the second ridge 60 may provide sufficient tactile feedback to indicate proper hand positioning to the base 122*a*.

Additionally, as seen in FIG. 8B, the base 122*a* may place his or her index finger of the hand supporting the rear-foot region 44 on the finger pad 82 on the heel side 80 of the upper. Placing a finger on the finger pad 82 may also help the base 122*a* support the ankle of the flyer 124 to keep the flyer 124 properly balanced during the stunt. The location of the finger pad 82 on the heel side 80 may be based on where the base 122*a* would natural rest his or her index finger to make placement of the index finger on the finger pad 82 intuitive.

The base 122*a* may grip the forefoot region 40 of the footwear 10 with the base's 122*a* other hand. Specifically, the base 122*a* may place one or more fingers on and around the forefoot grip 70. The non-textile material comprising the forefoot grip 70 and the stepped layers may help the base 122*a* hold onto the forefoot region 40 while the shape of the forefoot grip 70 may indicate proper hand positioning. For instance, the base's 122*a* index finder and/or middle finger may be placed over the portion of the forefoot grip 70 corresponding to the curve in the protruding edge 78. Accordingly, the base 122*a* may be able to feel when his or her hands are not in this proper position because the fingers will be touching the textile element 22 instead or the non-textile material forming the forefoot grip 70.

Figure 9A:
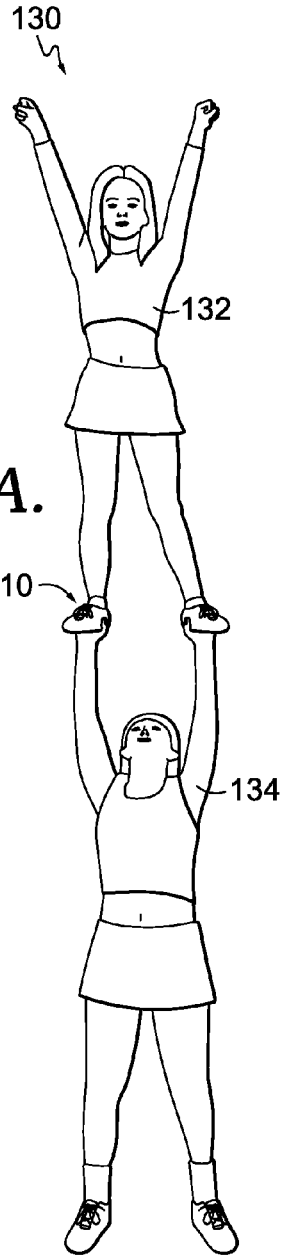
FIGS. 9A-B depict an exemplary use of the article of footwear of FIG. 1 in accordance with aspects hereof.
Figure 9B:
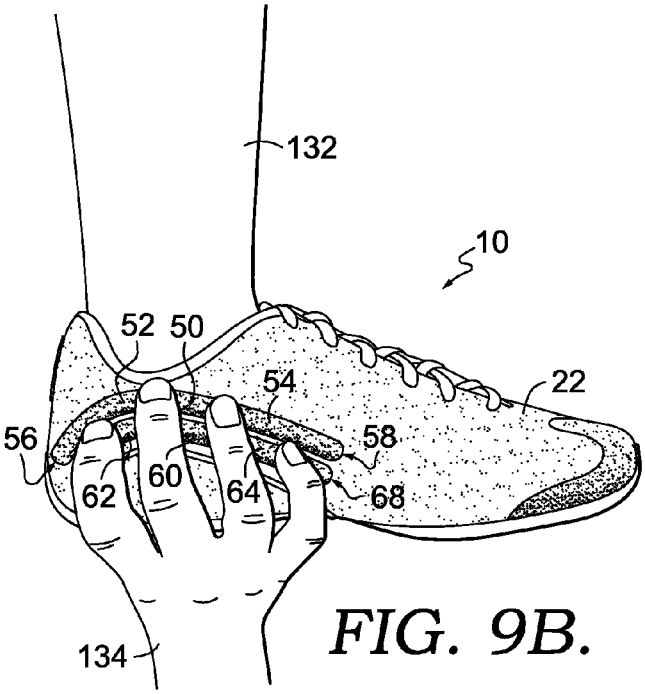

Turning to FIGS. 9A-9B, a single base extension 130 is illustrated. In FIG. 9A, one base 132 lifts up a flyer 134 by using two hands to support both feet of the flyer 134. In this single base extension stunt 130, the base's 132 hands are positioned differently than in the double base extension 120 because the base 132 uses only one hand to support a foot and because the base 132 is facing the same direction as the flyer 134, compared to the double base extension in FIG. 8A where both bases 122*a-b* faced directions perpendicular to the direction in which the flyer 124 faced. FIG. 9B provides a close-up view of the base's 132 right hand supporting the footwear 10 of the flyer 134. Here, the base 132 supports the rear-foot region 44 of the footwear 10 with the palm of the base's 132 hand, and the base 132 places his or her fingers on the lateral side of the footwear 10. As shown in FIG. 9B, the arch shape of the first ridge 50 and the second ridge 60 may generally correspond to the positioning of the base's 132 fingers along the lateral side of the footwear 10. In some embodiments, the most superior portions of the first ridge 50 and/or the second ridge 60 may indicate a position for the base 134 to place his or her middle finger to provide an appropriate amount of support to the flyer 134. Such as described with respect to FIGS. 8A and 8B, the setoffs 102 and 104 of the first and second ridges 50 and 60, respectively, and, in some embodiments, the change thereof may help the base 132 determine the proper positioning of the base's 132 fingers along the lateral side of the footwear 10.

Figure 10:
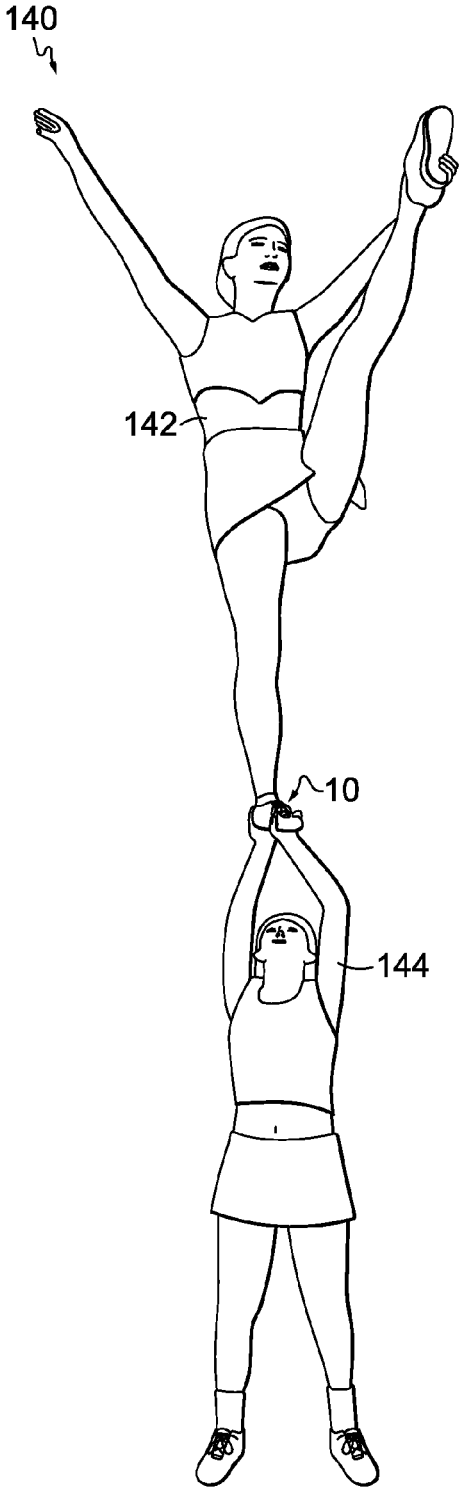
FIG. 10 depicts an exemplary use of the article of footwear of FIG. 1 in accordance with aspects hereof.

Continuing to FIG. 10, a single base, heel stretch extension 140 is depicted. Here, one base 142 supports one foot of the flyer 144 while the flyer 144 holds up the other foot. The base 142 may use two hands to support the standing foot of the flyer 144. One of the base's 142 hands may be generally positioned in the same manner shown in FIG. 9B, while the other hand may grasp the forefoot region 40 or the midfoot region 42 of the footwear 10 to provide additional support and balance.

Various aspects of the present disclosure have been provided in the precedent description, and these aspects may be combined in different manners. For example, an aspect includes an upper for an article of footwear, the upper comprising one or more textile elements coupled together, a first ridge, and a second ridge. The one or more textile elements include a lateral side, a medial side, a midfoot region, and a rear-foot region and have an inward-facing surface and an outward-facing surface. The first and second ridges each protrude from the outward-facing surface and away from the inward-facing surface. The first and second ridges also extend across the lateral side of the one or more textile elements towards the midfoot region from the rear-foot region. The first ridge is superior to the second ridge on the lateral side of the upper.

The first ridge includes a first-ridge first portion and a first-ridge second portion, the first-ridge second portion being closer to the midfoot region than the first-ridge first portion. Together, the first-ridge first portion and the first-ridge second portion form an arch, and the first-ridge first portion is more superior than the first-ridge second portion. Similarly, the second ridge includes a second-ridge first portion and a second-ridge second portion, the second-ridge second portion being closer to the midfoot region than the second-ridge first portion. The second-ridge first portion and the second-ridge second portion form an arch shape, and the second-ridge first portion is more superior than the second-ridge second portion.

Additionally, the first ridge includes a first-ridge setoff, which is the distance between the outward-facing surface of the one or more textile elements and an outward-facing surface of the first ridge. The second ridge includes a second-ridge setoff, which is the distance between the outward-facing surface of the one or more textile elements and an outward-facing surface of the second ridge. In some aspects, the first-ridge setoff, which may be in a range of about 5.0 millimeters to 3.0 millimeters, is greater than the second-ridge setoff, which may be in a range of about 4.0 millimeters and 2.0 millimeters. Further, the first-ridge setoff and the second-ridge setoff may gradually decrease towards the posterior ends of the first ridge and the second ridge, respectively. Some aspects further include a third ridge protruding from the outward-facing surface and away from the inward-facing surface and extending across the medial side of the upper towards the midfoot region from the rear-foot region.

Another aspect of the disclosure includes an article of footwear for providing tactile feedback. The article of footwear comprises a sole structure having at least an outsole; and an upper secured to the sole structure. The upper comprises one or more textile elements coupled together, one or more ridges, and a finger pad. The one or more textile elements include a lateral side, a medial side, a heel side, a forefoot region, a midfoot region, and a rear-foot region. The one or more textile elements further have an inward-facing surface and an outward-facing surface. Each of the one or more ridges protrudes from the outward-facing surface and away from the inward-facing surface and extending towards the midfoot region from the rear-foot region.

The finger pad is on the heel side of the upper and is at least partially positioned on an upper portion of the heel side of the upper. The finger pad comprises a non-textile material, such as a rubber material. The non-textile material is an extension of the outsole from a lower portion of the heel side to an upper portion. The profile of the finger pad corresponds to a shape of a distal portion of an index finger such that a person may position a portion of his or her index finger over the finger pad.

In some aspects, the upper of the article of footwear also includes a forefoot grip that extends over at least a portion of a superior surface of the forefoot region. The forefoot grip comprises one or more layers of non-textile material, such as TPU. The one or more layers includes a base layer, an intermediate layer and a top layer, the base layer being underneath the intermediate layer and the intermediate layer being underneath the top layer. A portion of the base layer is not covered by the intermediate layer and the top layer, and a portion of the intermediate layer is not covered by the top layer.

In yet a further aspect, an upper for an article of footwear includes one or more textile elements coupled together, the one or more textile elements including a lateral side, a medial side, a midfoot region, and a rear-foot region, the one or more textile elements having an inward-facing surface and an outward-facing surface. The upper further comprises a first ridge on the lateral side and a second ridge on the lateral side. Each of the first ridge and the second ridge protrude from the outward-facing surface and away from the inward-facing surface and extend towards the midfoot region from the rear-foot region. The first ridge includes a first-ridge first portion and a first-ridge second portion, the first-ridge first portion being more superior than the first-ridge first portion. Similarly, the second ridge includes a second-ridge first portion and a second-ridge second portion, the second-ridge first portion being more superior than the second-ridge second portion. The first-ridge first portion and the first-ridge second portion form a first arch shape, and the second-ridge first portion and the second-ridge second portion form a second arch shape. In some aspects, the first arch shape comprising the first ridge is superior to the second arch shape comprising the second ridge. Additionally, an outward-facing surface for each of the first ridge and the second ridge comprises a rounded curve that is convex with respect to the outward-facing surface of the one or more textile elements.

From the foregoing, it will be seen that aspects of this disclosure are well adapted to attain all the ends and objects hereinabove set forth together with other advantages that are obvious and are inherent to the structure. It will be understood that certain features and subcombinations are of utility and may be employed without reference to other features and subcombinations. This principle is contemplated by and is within the scope of the claims. Because many possible configurations and alternatives may be made of aspects herein without departing from the scope of this disclosure, it is to be understood that all matter herein set forth or shown in the accompanying drawings is to be interpreted as illustrative and not in a limiting sense. cm 1. An upper for an article of footwear, the upper comprising:

one or more textile elements coupled together, the one or more textile elements including a lateral side, a medial side, a forefoot region, a midfoot region, and a rear-foot region, the one or more textile elements having an inward-facing surface and an outward-facing surface;

a first ridge that protrudes from the outward-facing surface and away from the inward-facing surface, the first ridge extending from a first-ridge first end in the midfoot region to a first-ridge second end in the rear-foot region and including a first-ridge first portion and a first-ridge second portion, the first-ridge second portion being closer to the midfoot region than the first-ridge first portion, the first-ridge first portion being positioned more superiorly than the first-ridge second portion; and a second ridge that protrudes from the outward-facing surface and away from the inward-facing surface, the second ridge extending from a second-ridge first end in the rear-foot region to a second-ridge second end in the midfoot region and including a second-ridge first portion and a second-ridge second portion, the second-ridge second portion being closer to the midfoot region than the second-ridge first portion, the second-ridge first portion being positioned more superiorly than the second-ridge second portion, wherein the first ridge and the second ridge are on the lateral side of the upper and do not extend into the forefoot region, and wherein the first ridge is positioned superior to the second ridge.

The invention claimed is:

1. An upper for an article of footwear, the upper comprising:

one or more textile elements coupled together, the one or more textile elements including a lateral side, a medial side, a forefoot region, a midfoot region, and a rear-foot region, the one or more textile elements having an inward-facing surface and an outward-facing surface;

a first ridge that protrudes from the outward-facing surface and away from the inward-facing surface, the first ridge extending from a first-ridge first end in the midfoot region to a first-ridge second end in the rear-foot region and including a first-ridge first portion and a first-ridge second portion, the first-ridge second portion being closer to the midfoot region than the first-ridge first portion, the first-ridge first portion being positioned more superiorly than the first-ridge second portion; and a second ridge that protrudes from the outward-facing surface and away from the inward-facing surface, the second ridge extending from a second-ridge first end in the rear-foot region to a second-ridge second end in the midfoot region and including a second-ridge first portion and a second-ridge second portion, the second-ridge second portion being closer to the midfoot region than the second-ridge first portion, the second-ridge first portion being positioned more superiorly than the second-ridge second portion, wherein the first ridge and the second ridge are on the lateral side of the upper and do not extend into the forefoot region, and wherein the first ridge is positioned superior to the second ridge.

2. The upper of claim 1, wherein the first ridge includes a first-ridge setoff, the first-ridge setoff being a distance between the outward-facing surface of the one or more textile elements and an outward-facing surface of a middle portion of the first ridge, and wherein the second ridge includes a second-ridge setoff, the second-ridge setoff being a distance between the outward-facing surface of the one or more textile elements and an outward-facing surface of a middle portion of the second ridge.

3. The upper of claim 2, wherein the first-ridge setoff is greater than the second-ridge setoff.

4. The upper of claim 2, wherein the first-ridge setoff is in a range of about 3.0 millimeters to 5.0 millimeters and the second-ridge setoff is in a range of about 2.0 millimeters to 4.0 millimeters.

5. The upper of claim 2, wherein the first-ridge first end includes a first-ridge first-end setoff that is less than the first-ridge setoff at the middle portion of the first ridge and wherein the second-ridge first end includes a second-ridge first-end setoff that is less than the second-ridge setoff at the middle portion of the second ridge.

6. The upper of claim 5, wherein the first-ridge set off at the middle portion of the first ridge gradually decreases to the first-ridge first-end setoff at the first-ridge first end and wherein the second-ridge set off at the middle portion of the second ridge gradually decreases to the second-ridge first-end setoff at the second-ridge first end.

7. The upper of claim 2, wherein the first-ridge second end includes a first-ridge second-end setoff that is less than the first-ridge setoff at the middle portion of the first ridge and wherein the second-ridge second end includes a second-ridge second-end setoff that is less than the second-ridge setoff at the middle portion of the second ridge.

8. The upper of claim 7, wherein the first-ridge set off at the middle portion of the first ridge gradually decreases to the first-ridge second-end setoff at the first-ridge second end and wherein the second-ridge setoff at the middle portion of the second ridge gradually decreases to the second-ridge second-end setoff at the second-ridge second end.

9. The upper of claim 1, wherein the first ridge and the second ridge are formed in the textile element by high frequency welding.

10. An article of footwear for providing tactile feedback, the article of footwear comprising:

a sole structure having at least an outsole; and an upper secured to the sole structure, the upper comprising:

one or more textile elements coupled together, the one or more textile elements including a lateral side, a medial side, a heel side, a forefoot region, a midfoot region, and a rear-foot region, the one or more textile elements having an inward-facing surface and an outward-facing surface;

one or more ridges, each of the one or more ridges protruding from the outward-facing surface and away from the inward-facing surface and extending towards the midfoot region from the rear-foot region; and a forefoot grip extending over at least a portion of a superior surface of the forefoot region, the forefoot grip comprising one or more layers of non-textile material, the forefoot grip having a curved protruding edge that is offset in a lateral direction from a central midline of the upper.

11. The article of footwear of claim 10, wherein the one or more layers of the forefoot grip comprises a base layer, an intermediate layer and a top layer, the base layer being underneath the intermediate layer and the intermediate layer being underneath the top layer, wherein a portion of the base layer is not covered by the intermediate layer and the top layer and wherein a portion of the intermediate layer is not covered by the top layer.

12. The article of footwear of claim 10, wherein the upper further comprises a finger pad on the heel side of the upper, the finger pad comprising a non-textile material, wherein the finger pad is at least partially positioned on an upper portion of the heel side of the upper.

13. The article of footwear of claim 12, wherein the non-textile material of the finger pad comprises a rubber material.

14. The article of footwear of claim 12, wherein the finger pad comprises an extension of the outsole from a lower portion of the heel side to an upper portion.

15. The article of footwear of claim 12, the finger pad comprises a rectangular shape.

16. An upper for an article of footwear, the upper comprising:

one or more textile elements coupled together, the one or more textile elements including a lateral side, a medial side, a forefoot region, a midfoot region, and a rear-foot region, the one or more textile elements having an inward-facing surface and an outward-facing surface;

a first ridge on the lateral side, the first ridge protruding from the outward-facing surface and away from the inward-facing surface, the first ridge extending from a first-ridge first end in the midfoot region to a first-ridge second end in the rear-foot region and including a first-ridge first portion and a first-ridge second portion, the first-ridge first portion being positioned more superiorly than the first-ridge first portion; and a second ridge on the lateral side, the second ridge protruding from the outward-facing surface and away from the inward-facing surface, the second ridge extending from a second-ridge first end in the midfoot region to a second-ridge second end in the rear-foot region and including a second-ridge first portion and a second-ridge second portion, the second-ridge first portion being positioned more superiorly than the second-ridge second portion, wherein the first ridge and the second ridge do not extend into the forefoot region of the upper.

17. The upper of claim 16, wherein the first-ridge first portion and the first-ridge second portion form a first arch shape and wherein the second-ridge first portion and the second-ridge second portion form a second arch shape.

18. The upper of claim 16, wherein an outward-facing surface for each of the first ridge and the second ridge comprise a rounded curve that is convex with respect to the outward-facing surface of the one or more textile elements.

* * * * *